United States Patent [19]

Horsewell

[11] 4,366,826

[45] Jan. 4, 1983

[54] SMOKE FILTRATION

[75] Inventor: Henry G. Horsewell, Totton, England

[73] Assignee: British-American Tobacco Company Limited, London, England

[21] Appl. No.: 178,883

[22] Filed: Aug. 18, 1980

[30] Foreign Application Priority Data

Aug. 28, 1979 [GB] United Kingdom ..... 7929769

[51] Int. Cl.[3] ..... A24D 3/02; A24D 3/06

[52] U.S. Cl. ..... 131/336; 131/341; 131/343; 131/344; 131/345; 131/361; 131/362; 131/365; 131/95

[58] Field of Search ..... 131/331, 332, 336, 340, 131/341, 343, 344, 345, 361, 362, 365

[56] References Cited

U.S. PATENT DOCUMENTS

| | | | |
|---|---|---|---|
| 2,688,380 | 9/1954 | MacHenry | 131/332 |
| 3,079,978 | 3/1963 | Cobb, Jr. et al. | 131/343 |
| 3,111,702 | 11/1963 | Berger | 131/343 |
| 3,190,294 | 6/1965 | Dunlap | 131/343 |
| 3,361,137 | 1/1968 | Watson | 131/332 |
| 4,034,765 | 7/1977 | Van Hall | 131/336 |

*Primary Examiner*—V. Millin

*Attorney, Agent, or Firm*—Kane, Dalsimer, Kane, Sullivan and Kurucz

[57] ABSTRACT

A smoke-filter rod comprises a body of rod form consisting or having as at least major constituent a thermoplastics cellulose acetate or polypropylene smoke-filtration material, preferably of a fibrous or filamentary nature, and wrapped in a plugwrap comprising at least 50%, suitably at least 90%, by weight of fibres or filaments of, respectively, cellulose acetate or polypropylene material of substantially the same chemical identity as said major constituent of the filtration material, said plugwrap being bonded to said body and having a permeability for air of not less than 10,000 Coresta units. The bonding is by an agent which is a bonding agent for the material of said plugwrap and said filtration material, suitably triacetin in the case of cellulose acetate. Portions of such filter rod can be subjected to a hot-shaping process. For making such filter rod, a continuous tow or web of the smoke-filtration material may be impregnated with a bonding agent and gathered into a rod-form body and wrapped in continuous fibrous or filamentary plugwrap, whereby said plugwrap is bonded to said rod-form body. The rod formation and wrapping may be carried out by feeding the filtration material and plugwrap together to a garniture.

9 Claims, 2 Drawing Figures

SMOKE FILTRATION

Figure 1:
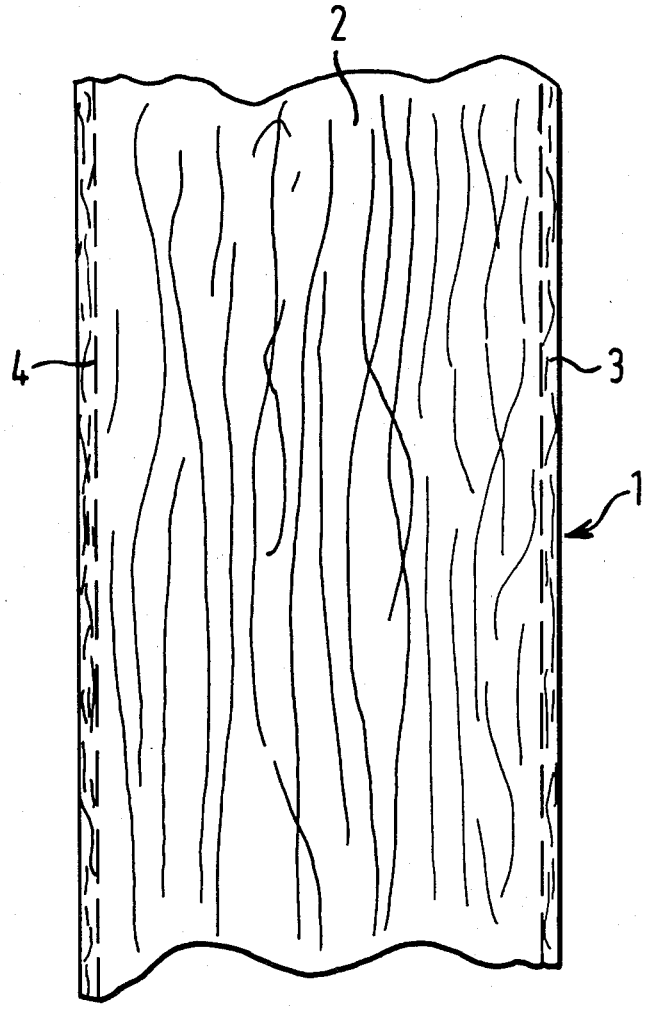

This invention relates to smoke filters, for tobacco smoke filtration for instance, and their production.

It is common practice to provide smoking articles, cigarettes for example, with a tobacco-smoke filter comprising a rod-form plug of fibrous material, for instance cellulose acetate, paper or polypropylene, which plug is wrapped in a paper plugwrap. Such wrapped plugs are derived from filter rod manufactured in continuous fashion on a filter-rod making machine to which are fed the filtration material, for example continuous cellulose acetate filament as a crimped tow from a bale thereof, and plugwrap in continuous strip form from a bobbin. The tow is spread and sprayed with a suitable plasticiser, such as triacetin in the case of cellulose acetate tow, and is passed to a garniture of the making machine which operates to bring the tow to rod form and to wrap it in the plugwrap. This mode of manufacturing filter rod is the curent orthodox method in the cigarette making industry.

Filter rod is also known which, instead of being provided with an enveloping plugwrap to provide stability, is made by a process which imparts a self-sustaining nature to the filtration material concerned.

Recently there has been increasing use of ventilated filters in filter-tip cigarette manufacture. Conventionally such a filter comprises a plug of fibrous filtration material wrapped in plugwrap, the filter being attached to the tobacco rod by a tipping paper. Provision is made for ventilation air to pass through the tipping paper by perforating it. Usually one or more rows of ventilation holes extend around the tipping paper. The underlying plugwrap must also permit the flow of the ventilation air therethrough and may for this purpose have a requisite degree of inherent porosity or be perforated, for example by an electrostatic or mechanical process. During cigarette manufacture, constant monitoring is required to ensure that the combined effects of variations in the ventilation holes in the tipping paper and in the permeability of the plugwrap do not produce an overall degree of ventilation outside predetermined tolerances, since it is the overall degree of ventilation which determines smoke-constituent deliveries of the cigarette.

The use of filter plugs cut from self-sustaining filter rod may simplify the problem of ensuring a consistent degree of ventilation because the use of such plugs having, as they do, porous peripheral surfaces, obviates the need for plugwrap.

It has heretofore been proposed to produce self-sustaining filter rod by passing plasticiser-impregnated tow through a die to gather it into rod form, the tow, while within the die, being treated with a hot gas or steam. Such a method of filter-rod production if disclosed in United Kingdom Patent Specification No. 970,817. In another proposed method of producing self-sustaining filter rod disclosed in United Kingdom Patent Specification No. 1,169,932, steam is passed into a gathered bundle of plasticiser-impregnated tow, but, instead of using a die to gather the tow into rod form, the tow is enveloped in a steam-pervious tape which serves to convey it through a heating enclosure in which the tow is contacted by the steam.

These methods of producing self-sustaining rod entail significant, costly and inconvenient departures from the orthodox mehtod of manufacture referred to above. Moreover, in carrying out the second of these methods, an impression of the mesh structure of the steam-pervious tape is formed in the peripheral surface of the rod. This is disadvantageous because, for example, it is difficult to determine the rod diameter for quality control purposes.

It is an object of the present invention to provide filter rod which, although similar to non-wrapped, self-sustaining, rod, having a porous peripheral surface, can be manufactured by the orthodox rod-making method for wrapped rod. It is a further object of the present invention to provide such filter rod having at its peripheral surface smoothness comparable with that of wrapped rod.

it has been proposed, in United Kingdom Patent Specification No. 1,110,785, to wrap a bundle of unplasticised cellulose acetate fibres in a wrapper, preferably of cellulose acetate film, bonded to the outer layer of cellulose acetate fibres. Filter rod made in this manner would, because of the absence of plasticiser, not reliably possess the rigidity generally associated with commercially acceptable selfsustaining filter rod. Moreover, the physical structure and chemical nature of the cellulose acetate film is markedly different from that of conventional paper plugwrap. Such film, which is physically similar to Cellophane (Trade Mark), lacks the fibous structure of paper and is substantially air impermeable. The filter rod would thus be significantly different from a self-sustaining cellulose acetate filter rod.

The present invention provides filter rod comprising a body of rod form having as at least major constituent a thermoplastics cellulose acetate or polypropylene smoke-filtration material and wrapped in a plugwrap comprising at least 50% by weight of fibres or filaments of, respectively, cellulose acetate or polypropylene material of substantially the same chemical identity as the said major constituent of the filtration material, said plugwrap having been bounded to said body and said plugwrap having a permeability for air of not less than 10,000 Coresta units.

The air permeability of sheet material in Coresta units is based on measurement of the rate of flow, expressed in cubic centimetres per minute, of air, which is caused to flow through a one square centimetre zone of the sheet material under a pressure difference, across the zone, of 10 centimetres of water.

Preferably the plugwrap is bonded to the rod-form body by a bonding agent which is a plasticiser or adhesive for the plugwrap and the smoke-filtration material. If required, the bonding may be enhanced by a light application of the bonding agent to the plugwrap prior to the wrapping of the filtration material in the plugwrap.

The present invention further provides a method of making smoke filter rod, wherein a continuous tow or web having as at least major constituent a thermoplastics cellulose acetate or polypropylene smoke-filtration material is impregnated with a bonding agent for siad material and is gathered into a rod-form body and wrapped in a continuous fibrous or filamentary plugwrap having a permeability for air of not less than 10,000 Coresta units, whereby said plugwrap is bonded to said rod-form body, said plugwrap comprising at least 50% by weight of fibres or filaments of, respectively, cellulose acetate or polypropylene material of substantially the same chemical identity as the said major constituent of the filtration material. The longitudinal plugwrap seam is preferably lap sealed.

Advantageously the smoke filtration material is of a fibrous or filamentary nature. In addition to the above-mentioned thermoplastics filtration material constituting the major constituent of the rod-form body, that body may further include contents of one or more other thermoplastics or non-thermoplastics materials. If the material constituting the said major constituent is a cellulose acetate material, the rod-form body may also include a content of polypropylene material and conversely. Preferably the plugwrap comprises not less than 80% by weight, advantageously not less than 90%, of the said thermoplastics material which is of substantially the same chemical identity as said major constituent of the rod-form body. However, the plugwrap may additionally include one or more further thermoplastics or non-thermoplastics materials. Cellulosic fibres, for instance wood pulp, may be included and the plugwrap may also contain strength-imparting additives and binders. The plugwrap may be made by a non-woven or conventional paper-making process.

It is essential that the plugwrap should possess sufficient tensile strength and be suitable in other respects for efficient running on a filter-rod making machine. Preferably the tensile breaking strength of the plugwrap should not be less than 50 g per mm of the plugwrap width.

By use of the present invention, there can be provided filter rod suitable for use in the hot-shaping process disclosed in the Specification of our U.S. Pat. No. 4149546.

Figure 2:
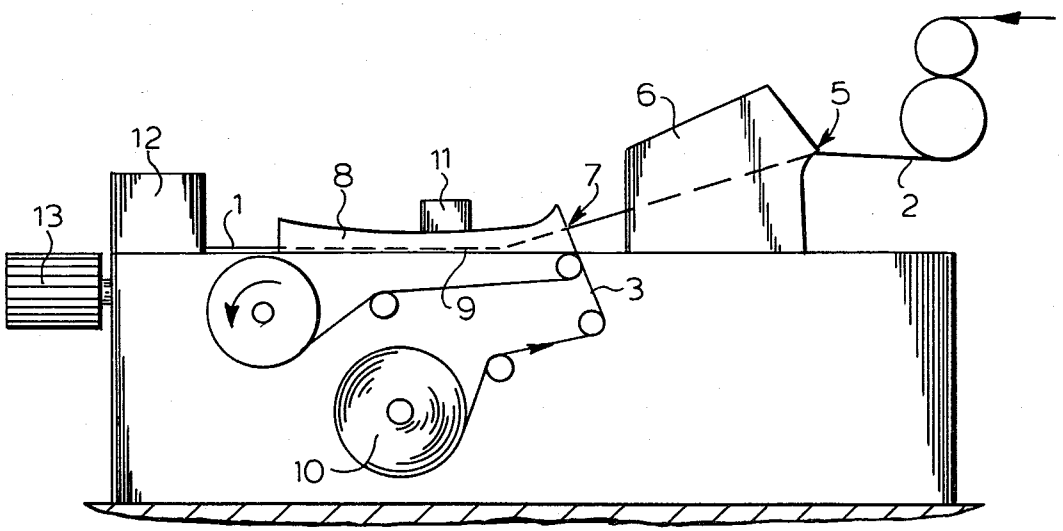

The following are examples of ways in which the invention may be carried into effect, reference being make to the accompanying drawings, in which:

FIG. 1 represents to a large scale a longitudinal section through a short length of filter rod from which cigarette filters are to be produced, and FIG. 2 is a diagrammatic side elevation of apparatus by which a method of producing filters in accordance with the invention can be obtained.

Referring to the drawing, filter-rod 1 illustrated in FIG. 1 consists of crimped tow 2 and plugwrap 3. The rod was produced upon what was basically a Hauni KDF 1 filter-rod making machine (FIG. 2), in which the crimped tow 2 was fed at 5 through an impregnation unit in which the tow was loaded with plasticising agent. Beyond the unit 6, the impregnated two passed at 7 into a gathering and wrapping unit comprising a garniture 8 provided with an endless, continuously moving, garniture tape 9. Introduced into the garniture 8 at the same time was a continuous web of plugwrap 3 drawn from a reel 10. In the garniture 8, the tow 2 became enwrapped in the plugwrap 3 and bonded thereto at the boundary 4 (FIG. 1) between them. An adhesive applicator 11 on the garniture provided adhesive for the plugwrap longitudinal seam. The continuous wrapped filter rod 1 issuing from the garniture 8 then passed through a severing device 12 in which portions of the rod were cut off and collected by a catcher 13 for use as filter elements.

EXAMPLE I

Filter rod 1 was made as described above from crimped cellulose acetate tow 2 of denier specification 8/36,000 and plugwrap 3 consisting of cellulose acetate fibres with 4.5% wood pulp and having a permeability of about 25,000 Coresta units, a tensile breaking strength of 60g per mm width, a weight of 31.4g/m$^2$, a width of 27mm and a thickness of 142 microns. The tow was plasticised and the plugwrap 3 bonded at boundary 4 to the tow 2, using triacetin. A PVA plugwrap adhesive supplied by Swifts Chemical Company Limited was used for the longitudinal plugwrap seam. The resultant filter rod 1 had a circumference of 24.85mm and gave a pressure drop of 150mm WG over a fully encapsulated length of 120mm. It was found to be closely similar to self-sustaining cellulose acetate filter rod made by the process of United Kingdom Specification No. 1,109,932. An equally advantageous product resulted when the cellulose acetate plugwrap had a permeability of about 32,000 Coresta units.

As alternative adhesive agents for the plugwrap seam, use may be made of triacetin (alone or with an addition of 3% of cellulose acetate), diethyl succinate of 1–3 butane diol diacetate.

Portions of filter rod thus manufactured with a plugwrap permeability of 25,000 Coresta units were employed in the hot-shaping process disclosed in U.S. Pat. No. 4149546 whereby grooved filter elements were formed. As the cellulose acetate plugwrap melted under the action of the hot-shaping process, the resultant filter elements were of a quality equal to that obtained when similar elements were made by subjecting portions of unwrapped self-sustaining cellulose acetate filter rod to the same process.

EXAMPLE II

Again using a Hauni KDF1 filter-rod making machine, filter rod was produced from crimped polypropylene tow and a plugwrap formed from a non-woven polypropylene sheet material having a permeability of about 25,000 Coresta units. An ethylene-vinyl acetate copolymer emulsion was used as plasticiser for the tow and bonding agent for the plugwrap. A hot melt adhesive was used for the plugwrap seam.

Portions of the filter rod were subjected to the above-mentioned hot-shaping process and used to produce filter elements.

Portions of filter rod produced in accordance with the invention can also be employed to produce filter elements for which hot-shaping by the aforesaid process is not required.

What is claimed is:

1. Smoke-filter rod which comprises a body of rod form having as at least major constituent a thermoplastics smoke-filtration material of the group consisting of cellulose acetate and polypropylene and wrapped in a plugwrap separate from said body but attached thereto by a bonding agent, the plugwrap comprising at least 50% by weight of fibres or filaments of a material of the said group of, respectively, substantially the same chemical identity as said major constituent of the filtration material and which has a permeability for air of not less than 10,000 Coresta units.

2. Filter rod according to claim 1, wherein said plugwrap is bonded to said body by an agent which is a bonding agent for the material of said fibres or filaments and for said filtration material.

3. Filter rod according to claim 1 or 2, wherein the smoke filtration material is of a fibrous or filamentary nature.

4. Filter rod according to claim 1 or 2, wherein the rodform body has cellulose acetate tow as at least said major constituent, and said fibres or filaments of the plugwrap are of cellulose acetate.

5. Filter rod according to claim 4, wherein the bonding agent is triacetin.

6. Filter rod according to claim 1 or 2, wherein the rodform body has polypropylene tow as at least said major constituent and said fibres or filaments of the plugwrap are of polypropylene.

7. Filter rod according to claims 1 or 2, wherein the plugwrap comprises at least 90% of said fibres or filaments.

8. A portion of filter rod according to claim 1 or 2, wherein said portion has been subjected to a hot-shaping process.

9. A method of making smoke-filter rod, wherein a continuous tow or web having as at least major constituent a thermoplastics filtration material of the group consisting of cellulose acetate and polypropylene is impregnated with a bonding agent for said material and is gathered into a rod-form body and wrapped in a continuous fibrous or filamentary plugwrap separate from said body but attached thereto by a bonding agent, the plugwrap having a permeability for air of not less than 10,000 Coresta units, said plugwrap comprising at least 50% by weight of fibres or filaments of a material of the said group of, respectively substantially the same chemical identity as the said major constituent of the filtration material.

* * * * *